US005555978A

United States Patent [19]

Elsner

[11] Patent Number: 5,555,978

[45] Date of Patent: Sep. 17, 1996

[54] WOUND ROLL AND CLOSURE STRIP ASSEMBLY

[75] Inventor: Bertram F. Elsner, Hanover, Pa.

[73] Assignee: Elsner Engineering Works, Inc., Hanover, Pa.

[21] Appl. No.: 539,715

[22] Filed: Oct. 5, 1995

[51] Int. Cl.[6] ..... B65D 85/671

[52] U.S. Cl. ..... 206/410; 206/389

[58] Field of Search ..... 206/389, 398–402, 206/410–416, 53–55; 242/159, 160.1, 160.2, 160.4

[56] References Cited

U.S. PATENT DOCUMENTS

| | | | |
|---|---|---|---|
| 441,846 | 12/1890 | Hurlbut . | |
| 785,822 | 3/1905 | Mitchem . | |
| 872,411 | 12/1907 | Greenwalt . | |
| 980,406 | 1/1911 | Casler . | |
| 1,087,916 | 2/1914 | Bauer . | |
| 1,226,677 | 5/1917 | Lafore . | |
| 1,457,625 | 6/1923 | Freydberg . | |
| 1,560,555 | 11/1925 | Flynn . | |
| 1,901,356 | 3/1933 | Plunkett . | |
| 2,070,317 | 2/1937 | Roesen | 242/58 |
| 2,082,489 | 6/1937 | Goldsmith | 242/55 |
| 2,086,179 | 7/1937 | Angier | 206/389 |
| 2,094,454 | 9/1937 | Keville | 206/59 |
| 2,141,109 | 12/1938 | Kemptgen | 206/400 |
| 2,199,862 | 4/1944 | Strovink | 91/86 |
| 2,353,789 | 7/1944 | Schieman | 164/60 |
| 2,454,864 | 11/1948 | Dexter | 206/389 |
| 2,537,588 | 1/1951 | Husson | 242/56 |
| 2,637,674 | 5/1953 | Stahl | 154/83 |
| 2,651,408 | 9/1953 | Engberg et al. | 206/56 |
| 2,660,299 | 11/1953 | Van Wirt | 206/59 |
| 2,676,765 | 4/1954 | Kaplan | 242/68 |
| 2,733,178 | 1/1956 | Stevenson | 154/53 |
| 2,751,936 | 6/1956 | Dunlap et al. | 137/78 |
| 2,857,047 | 10/1958 | Edelson | 206/58 |
| 2,914,167 | 11/1959 | Holtz | 206/59 |
| 3,022,170 | 2/1962 | Flinchbaugh et al. | 96/78 |
| 3,030,045 | 4/1962 | Rehklau | 242/74 |
| 3,115,246 | 12/1963 | Wicklund | 206/59 |
| 3,204,763 | 9/1965 | Gustafson | 206/59 |
| 3,247,956 | 4/1966 | Rosen | 206/59 |
| 3,467,334 | 9/1969 | Chestnut et al. | 242/58 |
| 3,469,683 | 9/1969 | Rijssenbeek | 206/58 |
| 3,505,150 | 4/1970 | Andersson | 156/446 |
| 3,547,739 | 12/1970 | Beute | 156/504 |
| 3,677,484 | 7/1972 | Yazawa et al. | 242/54 |
| 3,806,388 | 4/1974 | Contini | 156/184 |
| 3,826,441 | 7/1974 | Miles | 242/55 |
| 3,869,845 | 3/1975 | Rodach et al. | 53/137 |
| 3,901,757 | 8/1975 | Englinton | 156/446 |
| 4,003,469 | 1/1977 | Findlay | 206/410 |
| 4,094,727 | 6/1978 | Collins | 156/505 |
| 4,169,122 | 9/1979 | L'Feevre et al. | 264/160 |
| 4,177,959 | 12/1979 | Lancaster et al. | 242/58 |
| 4,195,787 | 4/1980 | Thomason | 242/1 |
| 4,422,588 | 12/1983 | Nowisch | 242/56 |
| 4,477,035 | 10/1984 | O'Connor | 242/67 |
| 4,581,083 | 4/1986 | Schutz et al. | 156/64 |
| 4,599,130 | 7/1986 | Woodley | 156/497 |
| 4,603,817 | 8/1986 | O'Connor | 242/1 |
| 4,795,105 | 1/1989 | Frei | 242/59 |
| 4,934,622 | 6/1990 | Hakiel | 242/68 |
| 4,964,513 | 10/1990 | Ingram et al. | 206/459 |
| 4,967,974 | 11/1990 | Kawamura | 242/55 |
| 4,974,784 | 12/1990 | Steidle | 242/56 |
| 4,984,750 | 1/1991 | Shigeta et al. | 242/58 |
| 4,989,801 | 2/1991 | Thomas et al. | 242/55 |
| 5,106,123 | 4/1992 | Shieh | 283/62 |
| 5,225,029 | 7/1993 | Arita et al. | 156/556 |
| 5,301,891 | 4/1994 | Duguay | 242/58 |
| 5,388,775 | 2/1995 | Duguay | 242/160 |

FOREIGN PATENT DOCUMENTS

| | | | |
|---|---|---|---|
| 487380 | 10/1952 | Canada | 206/398 |
| 154228 | 3/1921 | United Kingdom | 206/410 |

*Primary Examiner*—Jimmy G. Foster
*Attorney, Agent, or Firm*—Thomas Hooker, P.C.

[57] ABSTRACT

A roll of paper, metal foil, or plastic film is secured against unwinding by a helical adhesive strip wound around the middle of the roll more than 360°.

16 Claims, 2 Drawing Sheets

WOUND ROLL AND CLOSURE STRIP ASSEMBLY

FIELD OF THE INVENTION

The invention relates to a wound roll of web material having a free end on the outside of the roll. The end of the roll material is secured to the roll to prevent unwinding.

BACKGROUND OF THE INVENTION

Cylindrical rolls of web material, such as rolls of metal foil, food wrap plastic film, gift wrap paper, paper towels sold for home consumption necessarily have one end of the web material exposed on the outside of the roll. The exposed end of the web material must be secured to the roll to prevent the roll from unwinding during shipping and handling.

One conventional method of securing the end of the web material to the roll places an adhesive material between the exposed end of the web material and the underlying roll. Another method of securing the exposed end of the web material to the roll is apply a small piece of adhesive tape over the exposed end of the material to secure it to the underlying roll.

These methods of securing the material against unwinding present problems for both the manufacturer and the user. In high speed roll winding it is difficult to place an adhesive or tape accurately on a moving roll in exactly the correct position on the roll to secure the free end of the web material to the roll. Additionally, the strength with which the tape or glue adheres to the web material may cause damage to the underlying wrap of web material when the free end is pulled from the roll and the bond is broken. This damage makes the end of the web material unusable.

An additional conventional method of securing the exposed end of web material uses an adhesive string wrapped around the roll with the ends of the string extending to the ends of the roll. In order to remove the string it is necessary to grip an end of the string at one end of the roll. Gripping of the end of the string may injure the edge of the underlying web material.

SUMMARY OF THE INVENTION

The present invention is an improved roll assembly including a length of web material wound into a roll having an outer free end and a closure strip of low peel strength adhesive material helically wrapped more than one revolution around the center of the roll. The strip crosses the end of the web material to assure that the end of the web material is held on the underlying layer. The strip extends a distance to either side of the end of the web material to provide strong adhesive bonds between the strip and both the end of the web material and the underlying layer of web material. These bonds hold the end in place on the roll and prevent unwinding of the roll. The adhered strip includes portions preferably extending about one eighth of a revolution around the roll to either side of the free end of the web material. There is no need to locate the strip accurately on the roll to assure that the end of the web is held on the roll and does not unwind. The invention is particularly useful in roll assemblies sold for home consumption. These assemblies typically include rolls of paper, plastic film, and metal foil having diameters of typically ranging from 1.25 inch to 2.5 inches and lengths of about one foot. Gift wrap paper rolls are commonly longer than one foot.

Strips of a given length may be used to close rolls having different diameters. If a shorter length of web material is wound into the roll and consequently the diameter of the roll is smaller, the adhesive strip will extend a distance further around the smaller roll than the typical one and one quarter revolutions and the end will be captured.

The relatively low peel strength of the adhesive bond between the securing strip and roll permits ready removal of the strip from the roll without damage to the web material. An opening end of the strip facing in the same direction as the free end is simply lifted from the web and the strip is unwound without injury to the web material. The full length of web material is usable. The ends of the strip are located inwardly from the ends of the roll and are easily gripped for opening the roll without injury to the edges of the web material.

Optional markings on the securing strip instruct the user to first lift an opening end of the closure strip and then pull in a direction that lifts the end of web material from the roll. In this way, the end of the web material is lifted up and easily gripped for use. Location of the end of a web end on a roll of clear plastic food wrap film is facilitated.

Other objects and features of the invention will become apparent as the description proceeds, especially when taken in conjunction with the accompanying drawings illustrating the invention, of which there are three sheets and one embodiment.

DESCRIPTION OF THE PREFERRED EMBODIMENT

Figure 3:
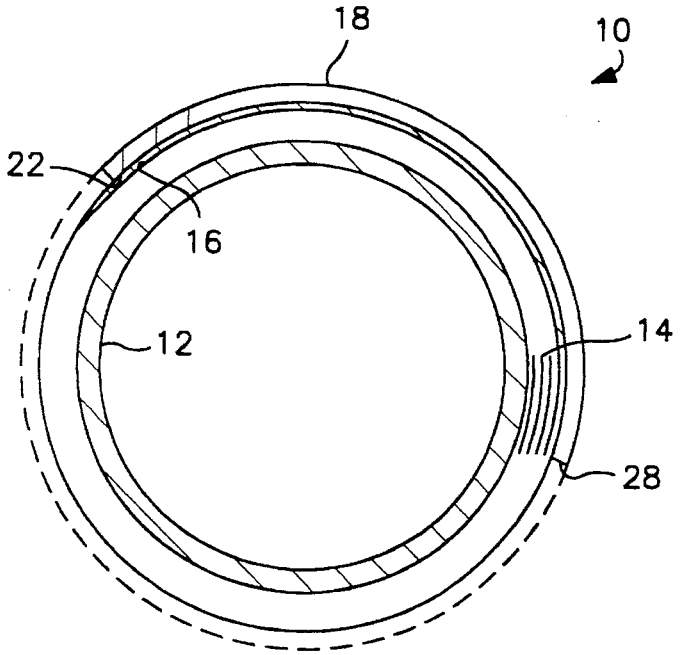
FIG. 3 is a sectional view along line 3—3 of FIG. 2.

Roll 10 includes an elongate hollow cylindrical core 12, which may be formed from cardboard, and a length of web material 14 wound as a cylindrical body on core 12. The edges of the web material define the ends of the roll body. The web material has an outer free end 16 which extends along the length of the roll. The web material may be a thin metal foil such as aluminum foil food wrap, a plastic film such as domestic food wrap film, gift wrap paper, paper toweling, or the like. The web material is typically wound on core 12 using automated high speed winding machines. In some applications, the roll may be wound without a core. The roll may have a diameter of about 1.25 inch to about 2.5 inches and a length of about one foot or more. Rolls of this type are commonly sold at retail for home use.

The free end 16 of the web material is held closed on the top of roll 10 against the underlying layer of web material by closure strip 18. The strip includes an elongate thin flexible plastic body 20 with a low peel strength adhesive 22 applied to the side of the body 20 on the roll. A plurality of spaced opening direction indicia or arrows 24 are provided on the side of body 20 away from adhesive 22. The arrows 24 identify the opening end and point along the strip in a direction from opening end of the strip 26 toward remote end 28. Body 20 may be formed from a suitable plastic such as polypropylene and may have a width of about ⅛ inch. Opening end 26 faces in the same circumferential direction as the free end 16 of the web material. The remote end faces in the opposite circumferential direction as free end 16. The body may be colored to facilitate location on a roll of transparent web material.

Closure strip 18 is helically wound around the center of roll 10 inwardly from ends 30 with the adhesive side of the strip engaging the outer surface of the roll. The flat thin strip does not project appreciably above the surface of the roll. The strip is sufficient to assure that the spiral extends about 1¼ revolutions or 450° around roll 10 and crosses the free end 16 of the web material at least once with an appreciable length of the adhered strip extending 45° to either side of the free end 16 of the web material. These 45° lengths tightly hold the free end on the roll and prevent unwinding of the web material during shipment and handling of the roll. The low peel strength adhesive 22 holding these portions of the strip to the web material is sufficiently strong to prevent inadvertent unwinding of the free end yet permits release of the strip without injury to the roll.

Strips 18 are preferably helically wound onto the rolls after the rolls are discharged from re-rolling equipment. The length of the strips assure the free ends of the web material are captured and held tightly against the roll independently of the circumferential location of the free ends on the roll relative to the strips. This feature simplifies the application of the strip to the roll since there is no need to locate the lead end of the web material accurately when the strip is helically wound around the roll.

The peel strength of the adhesive 22 holding the strip on the roll is adjusted according to the strength of the web material to assure that the strip tightly holds the free end on the roll and also that the strip may be peeled away from the roll without injury to the web material. Peel strength is conventionally defined as the force required to peel back a one inch wide plastic adhesive strip from a flat piece of steel and is expressed in ounces. The peel strength of conventional office tape is around 30 to 35 ounces. A low peel strength adhesive of about 8 ounces is used on closure strips for rolls of relatively delicate paper including gift wrap paper. Rolls wound from metal foil wrap or thin plastic film web material are stronger and permit the use of closure strips with an adhesive having a peel strength greater than 8 ounces. In some cases an adhesive having a peel strength as great as 30 to 35 ounces may be used. However, a strip with a low 8 ounce peel strip adhesive may also be used to hold the lead end of rolls formed from these materials.

Figure 4:
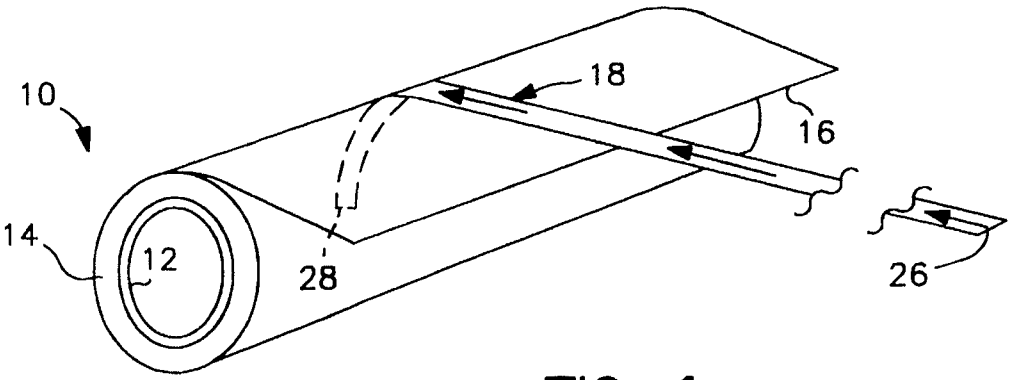
FIG. 4 is a view similar to FIG. 1 showing the strip partially unwound and the lead end of the web material lifted from the roll.

A roll 10 held closed by strip 18 is easily opened by a user by grasping opening end 26 of the strip and lifting the strip up from the underlying layer of web material. The adhesive 22 readily releases from the underlying layer without injuring the web material. Continued lifting of the strip raises the free end 16 of the web material from the underlying roll, as shown in FIG. 4. The arrows 24 permit the user to identify the opening end of the strip so that removal of the strip from the roll lifts the lead end 16 of the web material from the underlying roll. This feature permits easy location of the lead ends of rolls of thin transparent food wrap plastic film. The ends of these rolls are difficult to locate without the strip.

After the lead end of the web material roll has been lifted as shown in FIG. 4, it is a simple matter to peel the remainder of the strip from the web material. The entire length of the web material is then available for use as required.

If desired, the opening end 26 of strip 18 may include a short non-adhesive end portion to facilitate initial lifting of the strip by the user. This portion may be formed without an adhesive layer 22 or may be formed by folding the end of the strip back on itself so that the adhesive holds the folded back portion against the strip to provide a lift end or tab.

Figure 1:
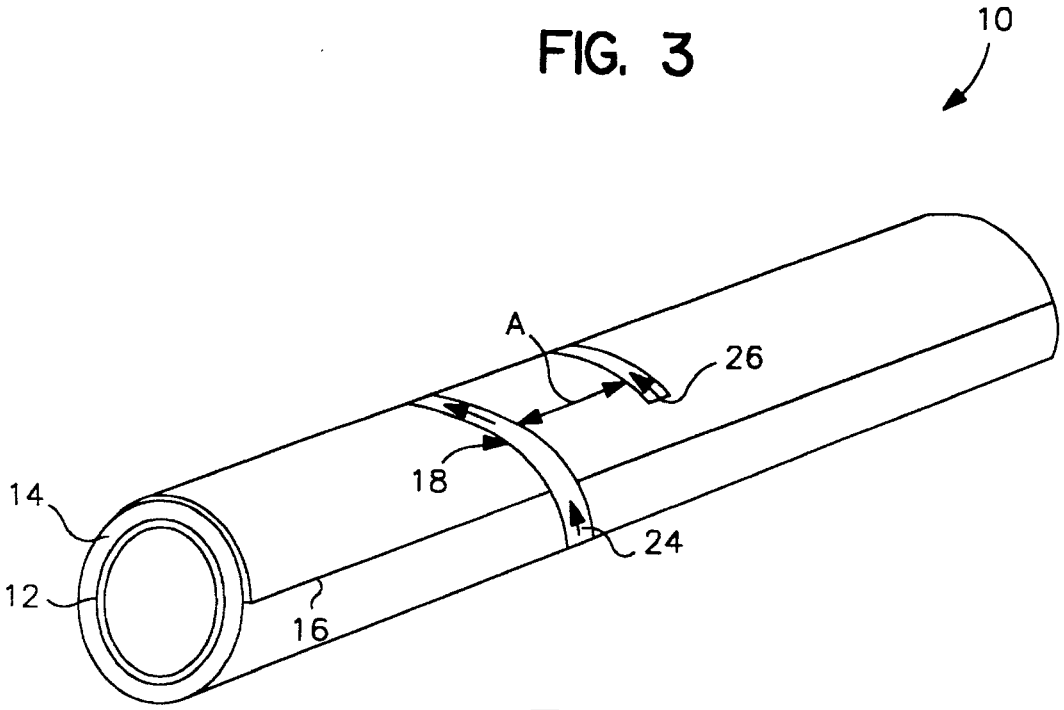
FIG. 1 is a perspective view of a cylindrical roll with the end of the web held on the roll by a helically wound closure strip.
Figure 2:
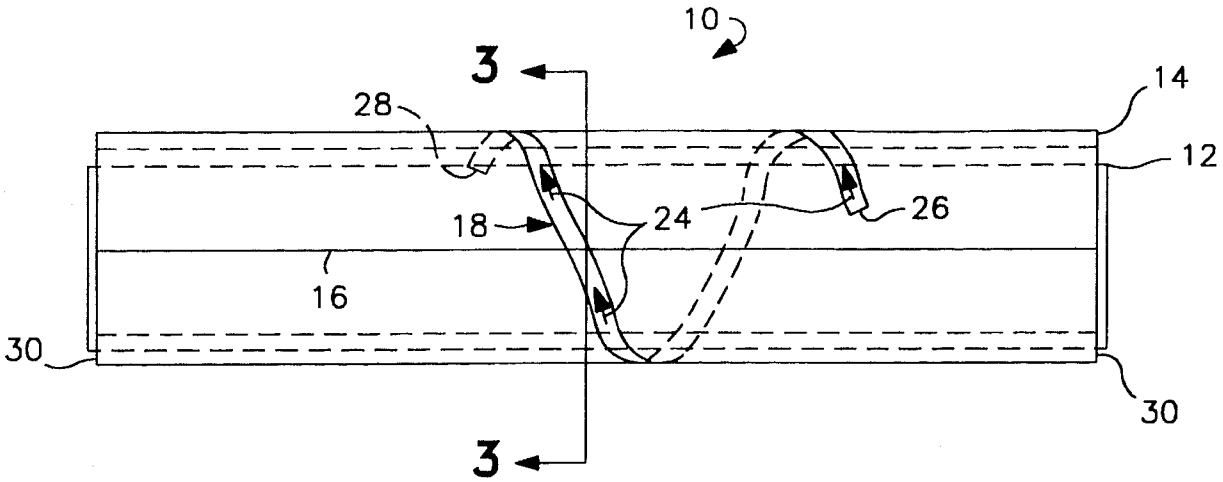
FIG. 2 is a top view of the roll shown in FIG. 1.

The helical wound strip 18 is wound roll 10 with the overlapping portions of the spiral strip at the ends of the strip separated from each other along the axial length of the roll a distance A as indicated in FIG. 1. Distance A is preferably ½ inch or more for rolls having a diameter between 1.25 inch to 2.5 inches and in practice may be about ¾ inch to 1 inch. The distance A assures that the opening end 26 of the strip is located away from the remainder of the strip to facilitate ready location and lifting of the lead end by the user as described.

The closure strip 18 is located in the center of roll 10 away from ends 30 in order to hold the entire lead end against unwinding and to assure that the opening end 26 of the strip is away from a roll end. Location of the opening end inwardly from the end of the roll assures that the user does not contact and injure the edges of the web material when the opening end 26 is lifted to open the roll.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A roll assembly comprising a length of web material having a free end, said web material wound into a cylindrical roll body having opposed body ends and a center with the free end extending between the body ends on the outside of the roll body; and a closure including a flexible body member having an opening end and a remote end, said opening and remote ends located inwardly of the roll body ends, said body member extending helically around the center of the roll body a circumferential distance greater than 360° and crossing the free end of the web material with the opening and remote ends overlapping the body member, said opening end facing in the same direction as the free end of the web material, and an adhesive on the body member and releasably adhered to the roll body, portions of the body member each extending to either side of the free end of the web material a distance sufficiently long to secure the free end to the roll body and prevent unwinding.

2. An assembly as in claim 1 wherein each portion extends approximately 45° around the roll body.

3. An assembly as in claim 1 wherein the closure comprises a thin plastic strip with the adhesive applied to one side of the strip, the strip extending approximately 450° circumferentially around the roll body and each portion extending approximately 45° circumferentially around the roll body.

4. An assembly as in claim 3 wherein the roll body has a diameter of about 1.25 inch to about 2.5 inches.

5. An assembly as in claim 4 wherein the web material is selected from the group consisting of paper, metal foil, and plastic film.

6. An assembly as in claim 5 wherein the opening end is spaced a distance of about 0.5 inch to about 1.0 inch from the overlapped part of the body member.

7. An assembly as in claim 6 wherein the adhesive has a peel strength greater than about 8 ounces per inch.

8. An assembly as in claim 5 wherein the closure includes indicia identifying the opening end.

9. An assembly as in claim 8 wherein the indicia are provided along the length of the closure.

10. An assembly as in claim 8 wherein the indicia comprises an arrow pointing away from the opening end.

11. An assembly as in claim 5 wherein said opening end is free of the roll body.

12. An assembly as in claim 1 wherein the roll body has a diameter of about 1.25 to about 2.5 inches, the body member comprises a flat plastic strip wound flat on the roll body, the adhesive is on one side of the strip and has a peel strength greater than about 8 ounces per inch, said strip extends approximately 450° around the roll body and the free end and the remote end are each spaced a distance of about 0.5 inch to about 1.0 inch from a overlapped part of the body member.

13. A roll assembly comprising a roll of web material selected from the group consisting of metal, foil, and plastic film, the roll having a center, opposed roll ends and a diameter less than about 2.5 inches, and a web material free end extending between the roll ends; and an elongate plastic closure strip helically wound flat around the center of the roll more than 360° and crossing the free end of the web material, said strip including an opening end and a remote end, the opening end facing circumferentially in the same direction as the free end of the web material, overlapping a portion of the strip and spaced from the overlapped portion of the strip a distance of about 0.5 inch to about 1.0 inch, and a releasable adhesive on one side of the strip, said adhesive releasably adhered to the roll to hold the strip flat on the roll and prevent unwinding of the free end of the web material, and opening end-identifying indicia on the other side the strip, said indicia permitting a user to distinguish the opening end from the remote end to facilitate lifting of the opening end from the roll for unwinding of the web material.

14. A roll assembly as in claim 13 wherein said adhesive has a peel strength greater than about 8 ounces per inch.

15. A roll assembly as in claim 13 where the strip extends approximately 450° circumferentially around the roll and includes portions each extending approximately 45° to either side of the free end of the web material.

16. A roll assembly as in claim 15 wherein the indicia are spaced along the length of the strip.

* * * * *

UNITED STATES PATENT AND TRADEMARK OFFICE

CERTIFICATE OF CORRECTION

PATENT NO. : 5,555,978

DATED : September 17, 1996

INVENTOR(S) : Bertram F. Elsner

It is certified that error appears in the above-identified patent and that said Letters Patent is hereby corrected as shown below:

Col. 1, line 23, after "is" insert --to--.

Col. 2, line 27, change "three" to --two--.

Col. 3, line 47, change "strip" to --strength--.

Col. 4, line 7, before "roll" insert --on--.

Col. 5,

Claim 12, line 8, change "a" to --an--.

Signed and Sealed this

Twenty-sixth Day of November 1996

*Attest:*

*Attesting Officer*

Bruce Lehman

BRUCE LEHMAN

*Commissioner of Patents and Trademarks*